US005838293A

United States Patent [19]

Kondoh

[11] Patent Number: 5,838,293

[45] **Date of Patent: *Nov. 17, 1998**

[54] DRIVING METHOD AND SYSTEM FOR ANTIFERROELECTRIC LIQUID-CRYSTAL DISPLAY DEVICE

[75] Inventor: Shinya Kondoh, Tokorozawa, Japan

[73] Assignee: Citizen Watch Co., Ltd., Tokyo, Japan

[ * ] Notice: The term of this patent shall not extend beyond the expiration date of Pat. No. 5,777,593.

[21] Appl. No.: 750,840

[22] PCT Filed: Apr. 25, 1996

[86] PCT No.: PCT/JP96/01144

§ 371 Date: Dec. 19, 1996

§ 102(e) Date: Dec. 19, 1996

[87] PCT Pub. No.: WO96/34311

PCT Pub. Date: Oct. 31, 1996

[30] Foreign Application Priority Data

Apr. 25, 1995 [JP] Japan ..... 7-099095

[51] Int. Cl.[6] ..... G09G 3/36

[52] U.S. Cl. ..... 345/97

[58] Field of Search ..... 345/97, 94, 96, 345/208, 209, 210

[56] References Cited

U.S. PATENT DOCUMENTS

| | | | |
|---|---|---|---|
| 5,136,282 | 8/1992 | Inaba et al. | 345/97 |
| 5,408,246 | 4/1995 | Inaba et al | 345/97 |
| 5,592,190 | 1/1997 | Okada et al. | 345/97 |
| 5,703,615 | 12/1997 | Usami | 345/97 |

FOREIGN PATENT DOCUMENTS

| | | |
|---|---|---|
| 3-174513 | 7/1991 | Japan . |
| 6-202078 | 7/1994 | Japan . |
| 7-20830 | 1/1995 | Japan . |

*Primary Examiner*—Richard A. Hjerpe
*Assistant Examiner*—Ronald Laneau
*Attorney, Agent, or Firm*—Finnegan, Henderson, Farabow, Garrett & Dunner, L.L.P.

[57] ABSTRACT

The present invention relates to a driving method and system for a display device adopting an antiferroelectric liquid crystal, and realizes a fast and excellent driving method for an antiferroelectric liquid-crystal display device in which, since the antiferroelectric liquid crystal is reset to a ferroelectric state at every writing, and the states of the antiferroelectric liquid crystal to be attained during a selection period and non-selection period respectively are defined, an after-image phenomenon can be alleviated. A scanning period is composed of a reset period, selection period, and non-selection period. During the reset period, the antiferroelectric liquid crystal is brought to a ferroelectric state. During the selection period, a pulse of 0 V or of opposite polarity is applied. During the non-selection period, the antiferroelectric liquid crystal is controlled to enter an antiferroelectric state or a ferroelectric state to be set with application of a voltage of the same polarity as a voltage to be applied during the reset period (FIG. 1).

30 Claims, 8 Drawing Sheets

PRIOR ART

PRIOR ART

DRIVING METHOD AND SYSTEM FOR ANTIFERROELECTRIC LIQUID-CRYSTAL DISPLAY DEVICE

TECHNICAL FIELD

The present invention relates to a driving method and system for an antiferroelectric liquid-crystal display device adopting an antiferroelectric liquid crystal as a liquid-crystal layer and having pixels arranged in the form of a matrix.

BACKGROUND ART

As is already known, a liquid crystal, in which dipoles have spontaneous polarizations whose orientations are aligned with each other due to dipole interaction between each pair of dipoles, and the orientations of the spontaneous polarizations are reversed with application of an external electric field, is referred to as a ferroelectric liquid crystal. By contrast, a liquid crystal assuming an antiferroelectric state, in which adjoining dipoles of molecules in a liquid-crystal layer are arranged in anti-parallel with each other so that the spontaneous polarizations of the dipoles will cancel out, is referred to as an antiferroelectric liquid crystal.

In recent years, many studies and attempts of practical use have been made on the former ferroelectric liquid crystal, and the ferroelectric liquid crystal has been adapted to various kinds of products. However, as well known, further improvements are requested in terms of the luminance of a display screen, responsiveness, and angle of visibility.

On the other hand, in the latter antiferroelectric liquid crystal, for example, Japanese Unexamined Patent Publication No. 2-173724 has suggested that the angle of visibility is larger than that permitted by a known nematic liquid crystal, fast response is permitted, and the multiplexing ability is excellent. The antiferroelectric liquid crystal has been under earnest study in various aspects.

The present invention attempts to improve the driving method for a display device adopting the latter antiferroelectric liquid crystal. According to the present invention, a fast, high-contrast, and high-quality display screen can be provided and utilized in a wide range of applications including applications to a liquid-crystal panel, liquid-crystal light shutter array, and the like.

DISCLOSURE OF THE INVENTION

An object of the present invention is to provide a driving method and system for realizing a fast, high-contrast, and high-quality display screen as a display screen for a display device adopting an antiferroelectric liquid crystal.

According to the present invention, an antiferroelectric liquid crystal is interposed between a pair of substrates. The antiferroelectric liquid crystal assumes a first ferroelectric state, a second ferroelectric state that is a ferroelectric state set with application of a voltage that is opposite in polarity to a voltage applied to set the first ferroelectric state, and an antiferroelectric state. One writing of pixels is achieved during at least one scanning period. The scanning period is composed of a selection period during which a select pulse for determining an amount of light transmitted by pixels is applied, a reset period during which a reset pulse for setting the antiferroelectric liquid crystal to a certain state is applied prior to the selection period, and a non-selection period during which the amount of transmitted light determined during the selection period is retained after the selection period.

The antiferroelectric liquid crystal assumes the first or second ferroelectric state during the reset period. During the selection period, the select pulse has 0 V or is a pulse that is opposite in polarity to the reset pulse. During the non-selection period, the antiferroelectric liquid crystal is brought to the antiferroelectric state or a ferroelectric state that is the same as a ferroelectric state set during the reset period.

Preferably, as far as an antiferroelectric liquid-crystal display device having a plurality of scan electrodes and a plurality of signal electrodes is concerned, the antiferroelectric liquid crystal assumes the first or second ferroelectric state during the reset period. During the selection period, the select pulse has 0 V or is a pulse that is opposite in polarity to the reset pulse. A voltage to be applied to the scan electrodes during the reset period has the same polarity as a voltage to be applied thereto during the non-selection period.

Preferably, for correcting a layer structure, a period during which the antiferroelectric liquid crystal assumes the first ferroelectric state and a period during which the antiferroelectric liquid crystal assumes the second ferroelectric state are defined within the same reset period. For shifting the state of the antiferroelectric liquid crystal to the first and second ferroelectric states, at least two kinds of reset pulses for bringing the antiferroelectric liquid crystal to the first and second ferroelectric states are applied to the antiferroelectric liquid crystal during the same reset period.

Preferably, a period during which the antiferroelectric liquid crystal assumes the first ferroelectric state, a period during which the antiferroelectric liquid crystal assumes the second ferroelectric state, and a period during which the antiferroelectric liquid crystal assumes the antiferroelectric states are defined within during the same reset period. For shifting the state of the antiferroelectric liquid crystal to the first and second ferroelectric states and antiferroelectric state, at least three kinds of reset pulses for bringing the antiferroelectric liquid crystal to the first and second ferroelectric states and antiferroelectric state are applied to the antiferroelectric liquid crystal during the same reset period.

Preferably, at least two kinds of reset pulses for bringing the antiferroelectric liquid crystal to the first ferroelectric state and second ferroelectric state are applied to the antiferroelectric liquid crystal during the same reset period. The select pulse has 0 V or is a pulse that is opposite in polarity to a last reset pulse for determining a ferroelectric state within a reset period. During the non-selection period, the antiferroelectric liquid crystal is brought to the antiferroelectric state or a ferroelectric state that is the same as a ferroelectric state set immediately before the start of the selection period during the non-selection period.

Preferably, as far as an antiferroelectric liquid-crystal device having a plurality of scan electrodes and a plurality of signal electrodes is concerned, at least two kinds of reset pulses for bringing an antiferroelectric liquid crystal to a first ferroelectric state and second ferroelectric state are applied to the antiferroelectric liquid crystal during the same reset period. A select pulse has 0 V or is a pulse that is opposite in polarity to a last reset pulse for determining a ferroelectric state during a reset period. A voltage to be applied to the scan electrodes immediately before the start of a selection period within the reset period has the same polarity as a voltage to be applied thereto during a non-selection period.

Preferably, at least three kinds of reset pulses for bringing the antiferroelectric liquid crystal to the first ferroelectric state, second ferroelectric state, and antiferroelectric state are applied to the antiferroelectric liquid crystal during the same reset period. The select pulse has 0 V or is a pulse that is opposite in polarity to a last reset pulse for determining a ferroelectric state within the reset period. During the non-selection period, the antiferroelectric liquid crystal is brought to the antiferroelectric state or a ferroelectric state that is the same as a ferroelectric state set immediately before the start of the selection period within the reset period.

Preferably, as far as an antiferroelectric liquid-crystal display device having a plurality of scan electrodes and a plurality of signal electrodes is concerned, at least three kinds of reset pulses for bringing an antiferroelectric liquid crystal to a first ferroelectric state, second ferroelectric state, and antiferroelectric state are applied to the antiferroelectric liquid crystal during the same reset period. A select pulse has 0 V or is a pulse that is opposite in polarity to a last reset pulse for determining a ferroelectric state within the reset period. A voltage to be applied to the scan electrodes immediately before the start of a selection period within the reset period has the same polarity as a voltage to be applied thereto during a non-selection period.

Preferably, the waveform of each voltage to be applied during consecutive scanning periods is symmetrical with respect to 0 V.

A driving system for an antiferroelectric liquid-crystal display device in accordance with the present invention comprises a means for generating display data, a driving means for driving scan electrodes, a driving means for driving signal electrodes, a power supply means for supplying a given voltage to pixels, and a control means for receiving the display data, determining the timing and voltages of signals in conformity with the display data, and supplying the timing and voltages to the scan electrode driving means and signal electrode driving means respectively.

One writing of pixels is carried out during at least one scanning period. The scanning period includes a selection period during which a select pulse for determining an amount of light transmitted by the pixels is applied, a reset period during which a reset pulse for setting the antiferroelectric liquid crystal to a certain state is applied prior to the selection period, and a non-selection period during which the amount of transmitted light determined during the selection period is retained.

The antiferroelectric liquid crystal assumes a first or second ferroelectric state during the reset period.

The select pulse is set to 0 V or a pulse that is opposite in polarity to the reset pulse.

The antiferroelectric liquid crystal is brought to the antiferroelectric state or a ferroelectric state that is the same as a ferroelectric state set during the reset period during the non-selection period.

BEST MODE FOR CARRYING OUT THE INVENTION

Prior to describing a driving method for an antiferroelectric liquid-crystal display device in accordance with the present invention, the structure of an antiferroelectric liquid-crystal cell to which the present invention is adapted and a light transmittance will be described in conjunction with FIGS. 6, 7, and 8, and the problems encountered with the prior art will be described in conjunction with FIGS. 9 and 10.

A well-known fundamental fact is that liquid-crystal molecules of an antiferroelectric liquid crystal each shift along the lateral side of a cone according to a change in external electric field. The cone is referred to as a liquid-crystal cone. The liquid-crystal cones are arranged in a vertical direction with respect to substrates having a liquid-crystal cell between them, and form a layer structure within the liquid-crystal cell (See FIGS. 10A–10B). Molecules of an antiferroelectric liquid crystal have spontaneous polarizations. The major axes of molecules within the same liquid-crystal layer are arranged in the same direction, and the spontaneous polarizations thereof are arranged in the same direction of either an up direction or a down direction. In the absence of an external electric field, however, the major axes of molecules in one liquid-crystal layer are shifted 180° from those of molecules in an adjoining liquid-crystal layer, and the orientations of the spontaneous polarizations of the molecules are also different by 180° from those of the spontaneous polarizations thereof in the adjoining liquid-crystal layer. In other words, if the spontaneous polarizations in a certain layer are oriented up, the spontaneous polarizations in layers adjoining the certain layer are oriented down. When an external electric field is applied to the antiferroelectric liquid-crystal cell and vertically to the surfaces of the substrates, the orientations of the spontaneous polarizations of all liquid-crystal molecules are aligned with a direction in which the external electric field is canceled. This causes the molecules to move along the lateral sides of the liquid-crystal cones. The orientations of the spontaneous polarizations in all layers are aligned with the same direction; an up or down direction.

Figure 6:
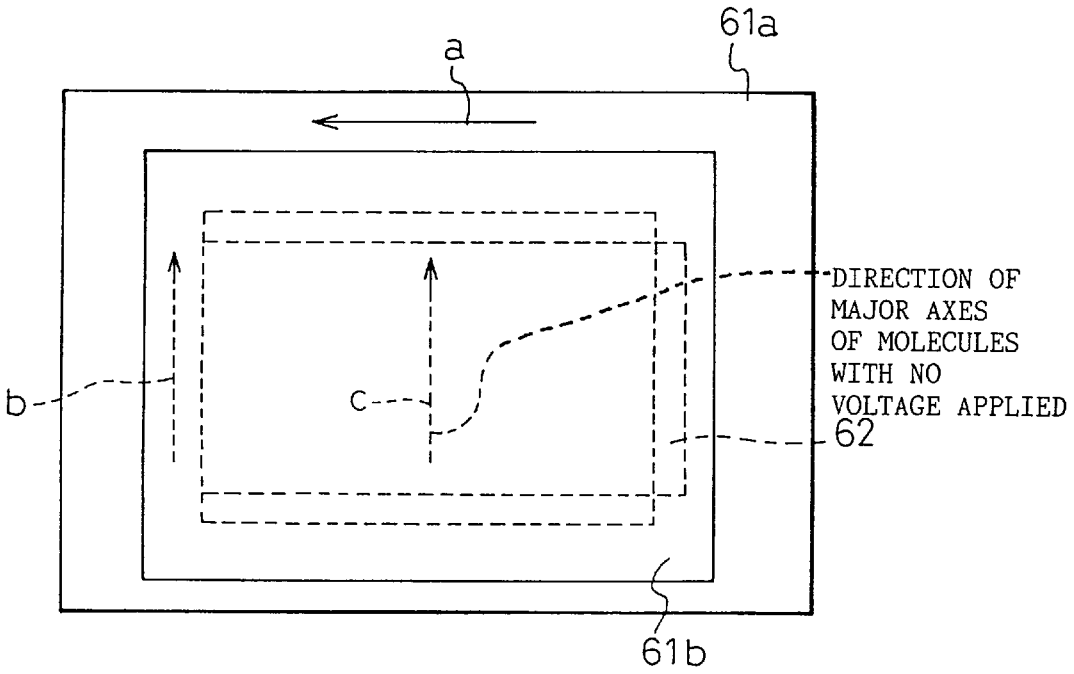
FIG. 6 is an arrangement diagram of an antiferroelectric liquid-crystal cell and polarizing plates to which the present invention is adapted.

FIG. 6 is an arrangement diagram of antiferroelectric liquid-crystal cells and polarizing plates to which the present invention is adapted, and shows the positions of the polarizing plates defined when an antiferroelectric liquid crystal is used as a display. As illustrated, liquid-crystal cells 62 are arranged between polarizing plates 61*a* and 61*b* whose axes of polarization (See arrows a and b) are matched with those of a cross-Nicol prism so that the axis of polarization of either of the polarizing plates (axis of polarization b in the drawing) will run parallel to the average direction of the major axes (c) of molecules in the absence of an electric field. Thus, when no voltage is applied, black appears. When a voltage is applied, white appears.

Figure 7:
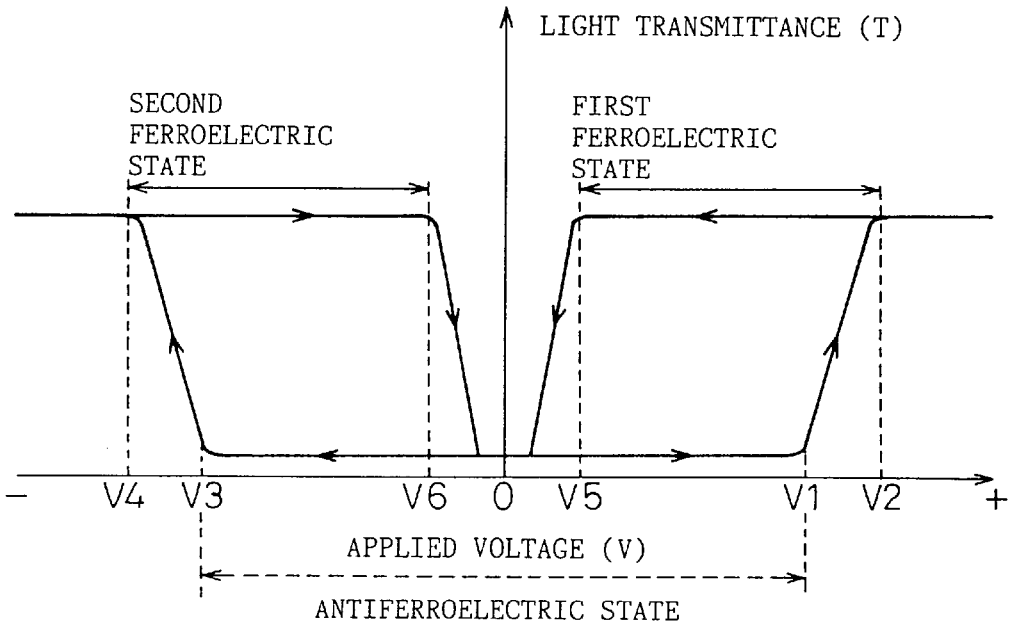
FIG. 7 is an explanatory diagram of a hysteresis loop exhibiting the characteristic of an antiferroelectric liquid crystal to which the present invention is adapted.

FIG. 7 is an explanatory diagram of a hysteresis loop that is a closed characteristic curve of a light transmittance versus an applied voltage in an antiferroelectric liquid-crystal display device to which the present invention is adapted, wherein a change in light transmittance resulting from application of a voltage to a liquid-crystal cell is graphically expressed by plotting light transmittances relative to different voltages. The axis of abscissae indicates applied voltages (V), and the axis of ordinates indicates light transmittances (or amounts of transmitted light, T). As illustrated, assuming that a voltage is applied and stepped up, a voltage at which the light transmittance starts changing is V1, and a voltage at which the change in light transmittance is saturated is V2. On the contrary, assuming that the applied voltage is stepped down from the saturation voltage V2, a voltage at which the light transmittance starts decreasing is V5. Moreover, assuming that a reverse voltage is applied and the absolute value of the voltage is increased, a voltage at which the light transmittance starts changing is V3, and a voltage at which the change in light transmittance is saturated is V4. On the contrary, assuming that the absolute value of the applied voltage is decreased from the saturation voltage V4, a voltage at which the light transmittance starts changing is V6.

As apparent from the graph, the applied voltages and light transmittances are plotted to draw a hysteresis loop. When a given voltage is applied to antiferroelectric liquid-crystal molecules, if the applied voltage is equal to or larger than a certain threshold, a first ferroelectric state (first steady state) is selected. When the applied voltage is reversed in polarity, a second ferroelectric state (second steady state) is selected. When the applied voltage falls below the certain threshold, an antiferroelectric state (third steady state) is selected but the above ferroelectric states are not.

Figure 8:
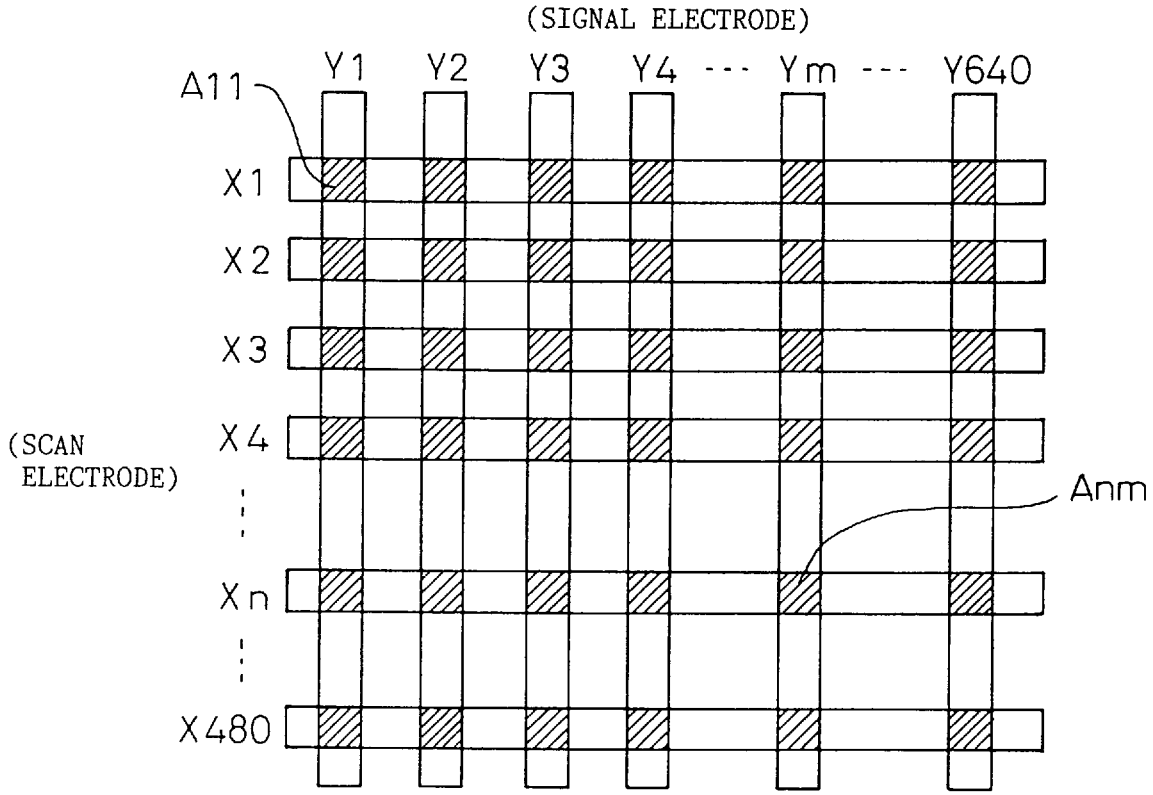
FIG. 8 is an arrangement diagram of scan electrodes and signal electrodes to which the present invention is adapted.

FIG. 8 is an arrangement diagram of scan electrodes and signal electrodes to which the present invention is adapted, showing an example of arrangement of a plurality of scan electrodes and a plurality of signal electrodes. The scan electrodes are denoted with X1, X2, etc., Xn, and X480, and the signal electrodes are denoted with Y1, Y2, etc., Ym, and Y640. Shaded areas in the drawing, that is, the intersections between the scan electrodes and signal electrodes are pixels (A11 to Anm). A driving method for the pixels (Anm) is such that voltages are applied to the scan electrodes (Xn) and signal electrodes (Ym) respectively, and a resultant synthetic voltage drives the pixels (Anm).

Taking an antiferroelectric liquid-crystal panel having the foregoing structure for instance, a known driving method and problems encountered with the method will be described below.

Figure 9:
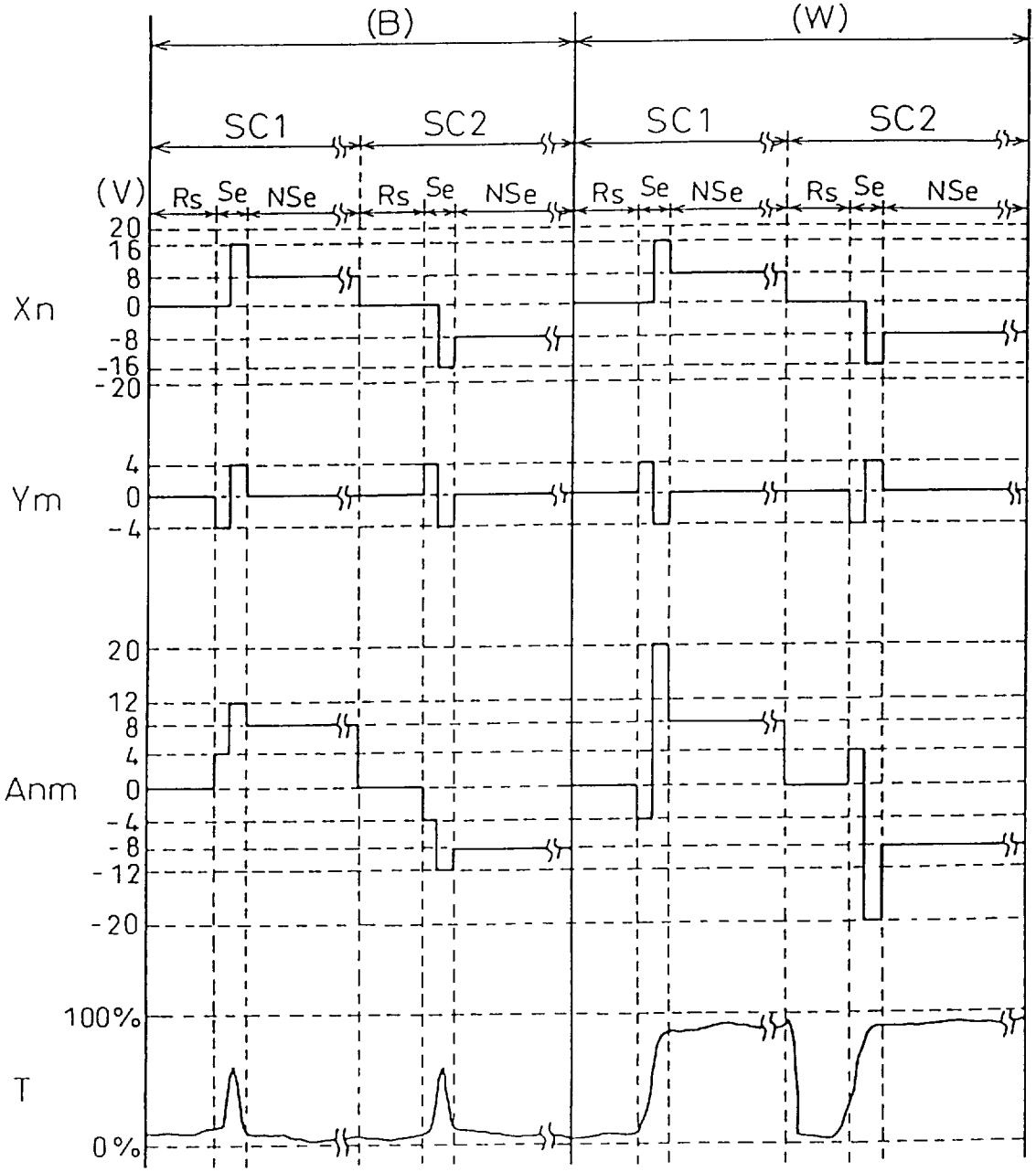
FIG. 9 is an explanatory diagram of a known driving method.

FIG. 9 is an explanatory diagram of the known driving method. In the drawing, OFF(B) means that no voltage is applied and a black display is achieved. ON(W) means that voltages are applied and a white display is achieved. SC1 denotes a first scanning period, and SC2 denotes a second scanning period. Rs denotes a reset period, Se denotes a selection period, and NSe denotes a non-selection period.

According to the known driving method, an antiferroelectric liquid crystal is brought selectively to the first or second ferroelectric state or the antiferroelectric state during the selection period. The state is retained during the next non-selection period. In other words, an amount of light transmitted with a select pulse applied during the selection period is retained during the subsequent non-selection period. Thus, display is achieved (See the amount of transmitted light T in the drawing).

However, if the states of the molecules of the antiferroelectric liquid crystal are different mutually at a time instant immediately before application of the select pulse during the selection period, it becomes hard to set an amount of light, transmitted by each pixel, accurately to a given value. For this reason, it often takes place that the antiferroelectric liquid crystal is reset to the antiferroelectric state irrespective of the state of each pixel before display before application of the select pulse.

As the method for resetting the liquid crystal to the antiferroelectric state, conventionally, as shown in FIG. 9, the voltage value during reset period (Rs) is set to 0 (v), and the liquid crystal is reset to the antiferroelectric state in accordance with relaxation due to viscosity or elasticity of the antiferroelectric liquid crystal, or as another method, the liquid crystal is reset to the antiferroelectric state by applying preferable supply voltage.

However the former method of resetting the antiferroelectric liquid crystal through relaxation of the molecules can reset the antiferroelectric liquid crystal reliably. However, if the states of pixels immediately before the start of a reset period is the first or second ferroelectric state, much time is required for reset. This poses a problem that screen writing is delayed.

By contrast, the latter method of resetting the antiferroelectric liquid crystal to the antiferroelectric state by applying an appropriate voltage is such that: when the state of the antiferroelectric liquid crystal immediately before a reset period is the first ferroelectric state, a voltage of negative polarity is applied during the reset period; and when the state of the antiferroelectric liquid crystal is the second ferroelectric state, a voltage of positive polarity is applied during the reset period. However, if the applied voltage is too low, the antiferroelectric liquid crystal cannot be reset to the antiferroelectric state. In contrast, if the applied voltage is too high, the antiferroelectric liquid crystal overshoots the antiferroelectric state and enters the first or second ferroelectric state. This poses a problem that the range of optimal applied voltages is very narrow.

As mentioned above, according to the known method of resetting the antiferroelectric liquid crystal to the antiferroelectric state, it is hard to carry out successful reset all the time and to achieve a fast high-contrast display.

Furthermore, for example, Japanese Unexamined Patent Publication No. 5-100208 and Japanese Unexamined Patent Publication No. 6-202078 filed by the present inventor have disclosed techniques analogous to the method of resetting an antiferroelectric liquid crystal to an antiferroelectric state, that is, methods of resetting an antiferroelectric liquid crystal to a ferroelectric state during writing.

To be more specific, according to the Japanese Unexamined Patent Publication No. 5-100208, a voltage that is high enough to bring an antiferroelectric liquid crystal to a ferroelectric state is applied before application of a gray-scale voltage, thus improving the responsiveness (start-up speed) of the liquid crystal. However, this method is intended to improve the response speed of an antiferroelectric liquid crystal at which the antiferroelectric liquid crystal enters the ferroelectric state. Driving for changing the antiferroelectric liquid crystal to an antiferroelectric state has been neither disclosed nor suggested.

On the other hand, the Japanese Unexamined Patent Publication No. 6-202078 has disclosed a technique for resetting an antiferroelectric liquid crystal to a ferroelectric state during a scanning period. The antiferroelectric liquid crystal is reset to the ferroelectric state in order to correct a difference in layer structure between a ferroelectric state and antiferroelectric state. The states of the antiferroelectric liquid crystal to be attained during a subsequent selection period and non-selection period are not defined. The patent publication has disclosed a driving method in which: after the antiferroelectric liquid crystal is reset to the ferroelectric state, the state is changed to another ferroelectric state during the selection period in order to display white; and the ferroelectric state different from the ferroelectric state attained during the reset period is retained during a retention period.

According to the driving method, however, a select pulse that is high enough to bring an antiferroelectric liquid crystal to another ferroelectric state must be applied during the selection period. For this reason, the voltage and pulse duration of the select pulse are required to be sufficiently great. The selection period must therefore be long. An improvement is therefor needed in terms of faster display.

Aside from the above problem, there is a problem that an antiferroelectric liquid crystal has a layer structure between glass substrates. The layer is bent near the center of a cell. M. Johno et al. has reported in the JJAP (Vol. 29, Jan. 1990) that the bend of the liquid-crystal layer is deformed by a voltage applied externally. In general, the threshold voltage of an antiferroelectric liquid crystal is dependent on the angle of bend of the layer.

The present inventor has found that the readiness of the layer for deforming is dependent on the material of a liquid crystal and the degree of deformation of the layer varies depending on an externally-applied voltage and an application time. In an antiferroelectric liquid-crystal display, after the same display is performed for a prolonged period of time, when another display is carried out, a so-called printing phenomenon takes place, that is, the previous state of display is seen as an after-image on a display screen. This is presumably because the magnitude of deformation of the layer differs from pixel to pixel (Refer to Japanese Unexamined Patent Publication No. 6-202078).

Figure 10A:
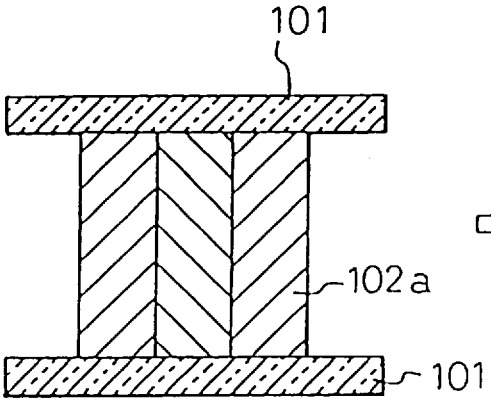
FIGS. 10A–10B are diagrams for explaining the problems encountered with a prior art.
Figure 10B:
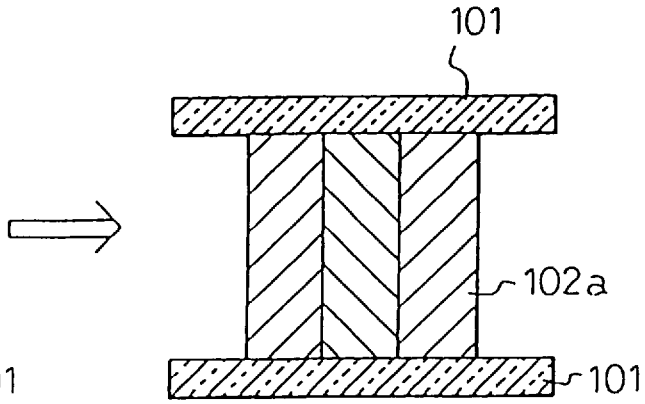
PRIOR ART Fig. 10B
Figure 10C:
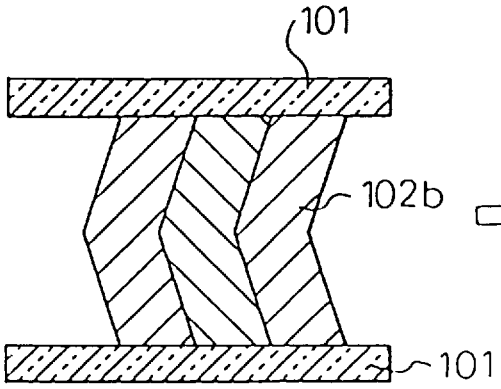
PRIOR ART Fig. 10C
Figure 10D:
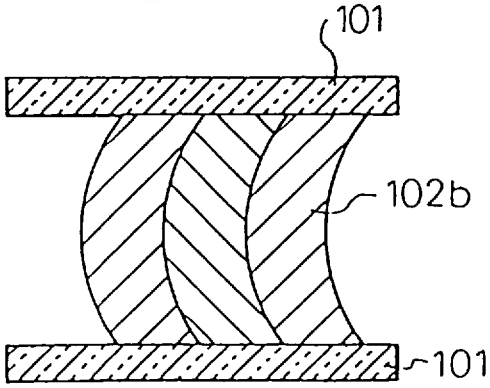
PRIOR ART Fig. 10D

FIGS. 10A–10D are a diagram for explaining the foregoing problems encountered with the prior art. There are shown glass substrates 101 and liquid crystal layers 102*a* and 102*b*. ON indicates a white display, while OFF indicates a black display. FIGS. 10A and 10B are concerned with a situation in which a white display is succeeded by a white display within the same pixel. FIGS. 10C and 10D are concerned with a situation in which a black display is succeeded by a white display within the same pixel. If the same display continues for a prolonged period of time, the size of a voltage to be applied to a pixel within a certain time is different between a pixel performing white display and a pixel performing black display. As illustrated, therefore, the angle of bend of a liquid-crystal layer differs between a pixel having performed a white display and a pixel having performed a black display. Specifically, when a white display is changed to a white display as shown in FIGS. 10A and 10B, the liquid-crystal layer does not change. When a black display is changed to a white display as shown in FIGS. 10C and 10D, the bend of the liquid-crystal layer changes. Since a threshold voltage is dependent on the angle of bend of the liquid-crystal layer, the threshold voltage also varies. From this viewpoint, when the same pattern is written in all pixels (for example, all pixels perform white display, that is, all the pixels are turned ON), immediately before the writing, some of the pixels perform a white display (ON) and the remaining pixels perform a black display (OFF). This means that the threshold voltage of the liquid-crystal layer becomes different from pixel to pixel. If an applied voltage is set to a voltage permitting pixels, at which the threshold voltage is low, to perform a white display, pixels at which the threshold voltage is high do not perform a white display with the applied voltage but maintain a black display. The pixels at which the threshold voltage is high are pixels which have performed a black display previously. Consequently, a preceding pattern is seen as if it were an after-image.

For eliminating the after-image, it is required to unify the way of bending of a liquid-crystal layer. An angle of bend of the liquid-crystal layer is decreased with application of a driving voltage to a liquid crystal (the layer becomes upright). However, as mentioned above, since a voltage to be applied to a pixel varies depending on the state of the display, that is, whether previous display is a white display or a black display, the angle of bend of the liquid-crystal layer differs with the state of display.

In consideration of the problems lying in the aforesaid known method of resetting an antiferroelectric liquid crystal to an antiferroelectric state, an object of the present invention is to provide a driving method for an antiferroelectric liquid-crystal display device enabling selection of a reset pulse among from a wide range of voltages, and permitting fast high-contrast display by correcting a change in structure of a liquid-crystal layer deriving from continuous driving and alleviating a printing phenomenon resulting from a difference in structure of the liquid-crystal from pixel to pixel.

Embodiments of the present invention will be described below.

As mentioned above, for realizing driving permitting fast high-contrast display, preferably, the state of an antiferroelectric liquid crystal is defined during driving to be performed after a reset period. According to a driving method of the present invention, the molecules of the antiferroelectric liquid crystal are brought by all means to a first or second ferroelectric state or to at least the first and second ferroelectric states during the reset period (Rs).

For example, a voltage that is equal to or larger than a threshold voltage and is necessary for the molecules of the antiferroelectric liquid crystal to switch from the first or second ferroelectric state to the second or first ferroelectric state is applied during the reset period. Normally, the voltage is higher than a voltage necessary for the antiferroelectric liquid crystal to switch from an antiferroelectric state to the first or second ferroelectric state. By applying the voltage equal to or higher than the threshold voltage, the liquid-crystal molecules are switched to the first or second ferroelectric state without fail. In this method, no restrictions are imposed on the voltage as long as the voltage is equal to or higher than the threshold voltage. According to this method, compared with the aforesaid known method of resetting an antiferroelectric liquid crystal to the antiferroelectric state, the range of applied voltages can be made wider. Compared with the method of resetting an antiferroelectric liquid crystal to the antiferroelectric state through relaxation that is a property of a liquid crystal, reset can be achieved very quickly.

Moreover, a select pulse to be applied during a selection period is 0 V or a pulse that is opposite in polarity to a reset pulse. The select pulse is a pulse for determining whether the molecules of an antiferroelectric liquid crystal that are set to the first or second ferroelectric state during the reset period are brought to a ferroelectric state (white display) to be set with application of a voltage of the same polarity as a voltage to be applied during the reset period or to an antiferroelectric state (black display) during the selection period.

Normally, as shown in FIG. 7, when a voltage exceeding a certain threshold voltage is applied to an antiferroelectric liquid crystal, the antiferroelectric liquid crystal shifts from an antiferroelectric state to a ferroelectric state or one ferroelectric state to another ferroelectric state. However, when the period of time during which a voltage is applied is insufficient, even if a voltage exceeding a threshold voltage is applied to the antiferroelectric liquid crystal, the antiferroelectric liquid crystal does not shift to another state. That is to say, both a sufficient voltage and sufficient application time are needed for causing the antiferroelectric liquid crystal to make a shift. For example, when a large select pulse that is opposite in polarity to a reset pulse is applied to an antiferroelectric liquid crystal that is brought to a first or second ferroelectric state during a reset period, if a selection period is short, the antiferroelectric liquid crystal that has been in the ferroelectric state during the reset period does not shift to a ferroelectric state to be set with application of a voltage that is opposite in polarity to a voltage to be applied during the reset period but changes to an antiferroelectric state, and is retained in the antiferroelectric state during a non-selection period. Moreover, when 0 V or a small pulse that is opposite in polarity to the reset pulse is applied as the select pulse, since the selection period is short, the antiferroelectric liquid crystal that has entered the ferroelectric state during the reset period does not shift to the antiferroelectric state. However, a ferroelectric state to be set with application of a voltage having the same polarity as a voltage to be applied during the reset period is selected and retained during the non-selection period.

In short, whether an antiferroelectric state or original ferroelectric state is set during the selection period is determined in terms of an application time and applied voltage. If a selection period is fixed to short in order to realize fast driving, the state of an antiferroelectric liquid crystal becomes dependent on the size of the voltage of a select pulse. The select pulse voltage varies depending on an employed material of an antiferroelectric liquid crystal. The size of the voltage should therefore be determined in consideration of various factors such as the material of a liquid crystal and the material of an alignment membrane.

As described in conjunction with FIGS. 10A–10D, if the same display continues for a prolonged period of time, the size of a voltage to be applied to a pixel during a certain period of time becomes different between a pixel performing a white display and a pixel performing a black display. The angle of bend of a liquid-crystal layer is therefore different between a pixel having performed a white display and a pixel having performed a black display. Moreover, since the threshold voltage of the liquid-crystal layer is dependent on the angle of bend thereof, the threshold voltage also becomes different from pixel to pixel. Even if the same voltage is applied for white display, some pixels do not switch from an antiferroelectric state to a ferroelectric state. Consequently, a previous pattern is seen as if it were an after-image. For resolving this (after-image) phenomenon, the way of bending of the liquid-crystal layer must be held uniform irrespective of the state of display. For resolving the after-image phenomenon, the angle of bend of the liquid-crystal layer must be set to a saturated level (whatever voltage is applied as a pulse, the angle of bend thereof does not change) irrespective of the state of display.

The results of subsequent studies made by the present inventor et al. have revealed that when a bipolar pulse having a higher voltage is applied continuously during a reset period, the angle of bend of a liquid-crystal layer can approach a saturated level.

For example, a pulse having a voltage that is high enough to bring an antiferroelectric liquid crystal to first and second ferroelectric states is applied to bring the antiferroelectric liquid crystal alternately to the first and second ferroelectric states. This causes the angle of bend of a liquid-crystal layer to further approach to the saturated level. When a bipolar pulse having a voltage that is high enough to switch the antiferroelectric liquid crystal to the first and second ferroelectric states is applied during a reset period, the angle of bend of the layer of the antiferroelectric liquid crystal is saturated irrespective of the state of display. Consequently, the angle of bend of the layer will not differ with the state of display. As a result, fluctuations of a threshold voltage will not occur and a printing phenomenon will not take place.

As mentioned above, the Japanese Unexamined Patent Publication No. 6-202078 describes that all pixel locations of an antiferroelectric liquid crystal are reset to a ferroelectric state for the purpose of correcting a difference in structure of a liquid-crystal layer. However, according to this driving method, the antiferroelectric liquid crystal is reset to either of the first and second ferroelectric states. According to the present invention, the antiferroelectric liquid crystal is reset to at least both the first and second ferroelectric states. Thus, the angle of bend of the liquid-crystal layer can be corrected more effectively than it is when the antiferroelectric liquid crystal is reset to one of the states.

A driving method of the present invention to be described later is such that the state of an antiferroelectric liquid crystal is reset at every writing in order to stabilize display for each writing, and the antiferroelectric liquid crystal is brought to a ferroelectric state during a reset period. Consequently, the application range of a reset pulse can be made wide. Moreover, 0 V or a select pulse that is opposite in polarity to the reset pulse is applied during a short selection period in order to determine the state of display. It is therefore possible to change the antiferroelectric liquid crystal to either the ferroelectric state or an antiferroelectric state successfully. This enables fast display. Furthermore, since the angle of bend of a liquid-crystal layer in the layer structure of the antiferroelectric liquid crystal is kept constant irrespective of the state of display, fluctuations of a threshold voltage dependent on the state of display are nullified, and eventually a printing phenomenon is alleviated.

An embodiment of the present invention will be described in more detail, in conjunction with the drawings, below.

Figure 5:
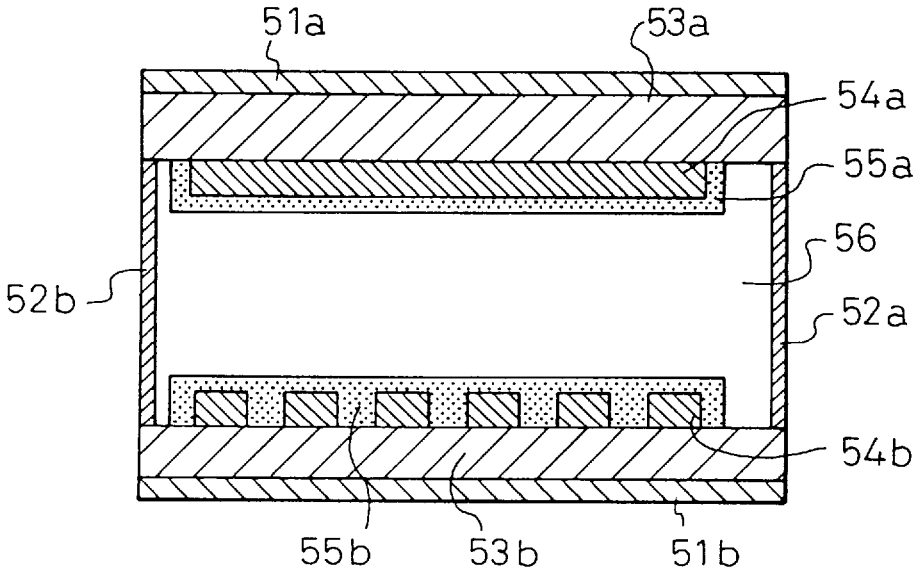
FIG. 5 is a sectional structural diagram of an antiferroelectric liquid-crystal cell to which the present invention is adapted.

Prior to a driving method of an embodiment of the present invention illustrated in FIG. 1, the structure of a liquid-crystal panel employed in the embodiment will be described in conjunction with FIG. 5. The liquid crystal panel employed in this embodiment comprises a pair of glass substrates 53*a* and 53*b* having an antiferroelectric liquid-crystal layer 56 of approximately 2 micrometers thick between them. Electrodes 54*a* and 54*b* are formed on opposed sides of the glass substrates, and polymer alignment membranes 55*a* and 55*b* are coated over the electrodes 54*a* and 54*b*. The surfaces of the membranes have been rubbed.

A first polarizing plate 51*a* is placed on the outer side of one of the glass substrates, that is, of the glass substrate 53*a* so that the axis of polarization will be parallel to the axis of rubbing. A second polarizing plate 51*b* is placed on the outer side of the other glass substrate 53*b* so that the axis of polarization will be 90° deviated from that of the first polarizing plate 51*a* (cross Nichol prism). 52*a* and 52*b* denote seal members for immobilizing the upper and lower glass substrates.

Figure 1:
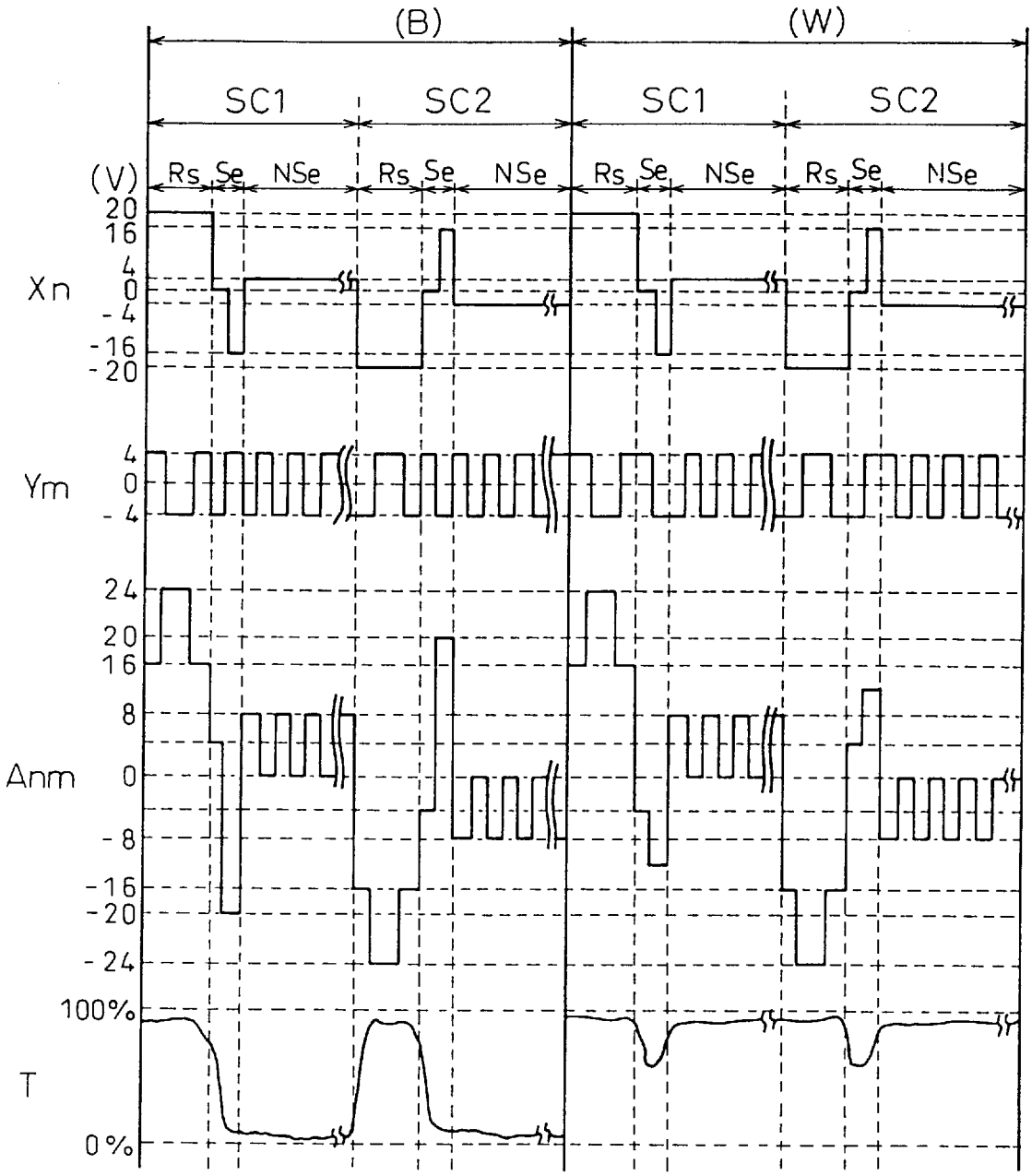
FIG. 1 is an explanatory diagram of a driving method of an embodiment of the present invention.

FIG. 1 illustrates a driving method of an embodiment of the present invention, showing the waveforms of voltages to be applied to scan electrodes (Xn), the waveforms of voltages to be applied to signal electrodes (Ym), the waveforms of synthetic driving voltages developed at pixels (Anm) at the intersections of the scan electrodes and signal electrodes for a white display (ON(W)) and a black display (OFF(B)) respectively, and the changes in amount of transmitted light (T).

The driving waves employed in the present invention have four phases thereof during a reset period (Rs) and two phases thereof during a selection period (Se). The pulse duration for one phase is set to 50 microseconds. One writing is achieved during first and second scanning periods (SC1 and SC2). The time of a non-selection period (NSe) is much longer than that of the selection period or approximately 45 milliseconds. A retaining voltage of 4 V is applied to the scan electrodes during the non-selection period. The retaining voltage has the same polarity as a voltage to be applied during the reset period.

A maximum absolute value of a peak value of a pulse to be applied to the scan electrodes during the reset period is 20 V, and a maximum absolute value of a pulse to be applied to the signal electrodes is 4 V. For a black display, a synthetic voltage of 24 V to be applied to pixels during the first scanning period is applied by two phases (reset pulse). This brings the antiferroelectric liquid crystal to the first ferroelectric state. The amount of transmitted light (T) approaches to 100% during the reset period. During the next selection period, since a pulse of −20 V is applied to pixels by one phase (select pulse), the antiferroelectric liquid crystal does not shift to a ferroelectric state to be set with application of a voltage of opposite polarity. The antiferroelectric state is selected. The amount of transmitted light becomes 0%. A black display ensues. During the non-selection period, the antiferroelectric liquid crystal retains the antiferroelectric state. Since the reset period is shorter than the time required for a viewer to discern a change in display, the display is discerned as black.

For a white display, a synthetic voltage of 24 V is applied to pixels (Anm) by two phases during the reset period (reset pulse). This brings the antiferroelectric liquid crystal to the first ferroelectric state. The amount of transmitted light (T) approaches to 100%. During the next selection period, since −12 V is applied to the pixels by one phase (select pulse), the antiferroelectric liquid crystal does not shift to the antiferroelectric state but enters a ferroelectric state to be set with application of a voltage of the same polarity as the voltage applied during the reset period. The amount of transmitted light (T) approaches 100%. A white display ensues. During the non-selection period, the antiferroelectric liquid crystal retains the ferroelectric state to be set with application of a voltage of the same polarity as the voltage applied during the reset period. White display ensues.

As mentioned above, one writing is achieved during two scanning periods (SC1 and SC2). The waveform of each voltage to be applied during the periods is symmetrical with respect to 0 V, and thus the voltage is alternating.

The application range of a reset pulse is widened, and the time required for resetting the antiferroelectric liquid crystal to a ferroelectric state is shortened. For both a black display and a white display, the selection period can be shortened. For any display screen, an excellent display can be achieved quickly.

Figure 2:
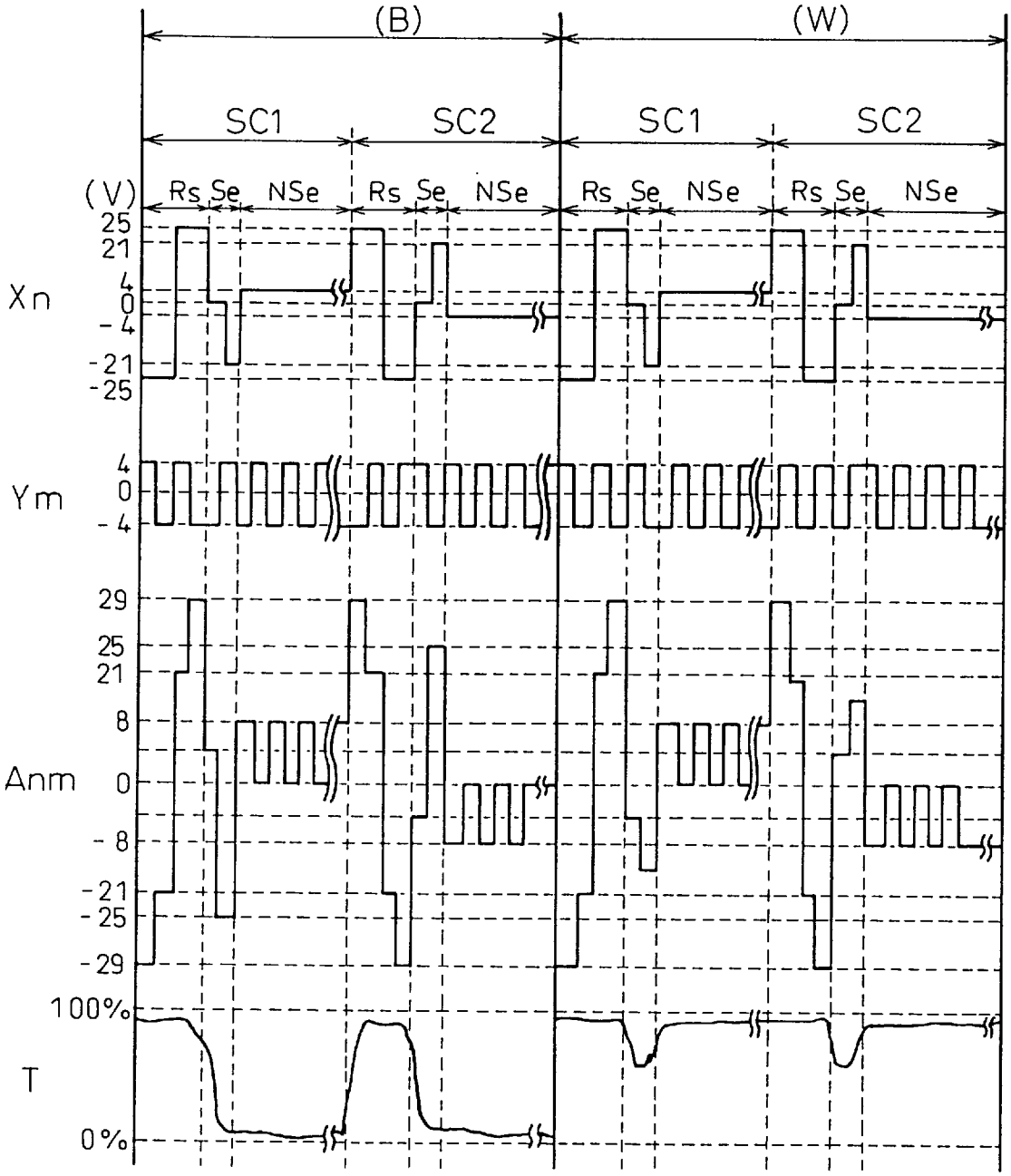
FIG. 2 is an explanatory diagram of a driving method of another embodiment of the present invention.

FIG. 2 illustrates a driving method of another embodiment of the present invention. Like FIG. 1, FIG. 2 shows the waveforms of voltages to be applied to scan electrodes (Xn), the waveforms of voltages to be applied to signal electrodes (Ym), and the waveforms of synthetic driving voltages to be applied to pixels (Anm) at the intersections of the scan electrodes and signal electrodes, for a white display (ON (W)) and a black display (OFF(B)) respectively, and the proportional changes in amount of transmitted light (T). The driving waves employed in the present invention have four phases thereof during a reset period (Rs) and two phases thereof during a selection period (Se). In the same manner as the aforesaid embodiment, the pulse duration of one phase is set to 50 microseconds. One writing is achieved during two scanning periods (SC1 and SC2). The time of a non-selection period (NSe) is approximately 45 milliseconds. A retaining voltage of 4 V is applied to scan electrodes during the non-selection period. A pulse to be applied during the reset period consists of two phases. In other words, two pulses of opposite polarities are applied during the reset period, and the polarities are reversed alternately (two kinds of reset pulses). Moreover, the retaining voltage to be applied during the non-selection period has the same polarity as a last pulse applied during the reset period.

A maximum absolute value of a peak value of a pulse to be applied to scan electrodes during the reset period is 25 V, and a maximum absolute value of a pulse to be applied to signal electrodes is 4 V. For a black display, as a synthetic voltage to be applied to pixels during the first scanning period, a voltage independent of display data, having an absolute value of 21 V or higher, and consisting of two phases is applied alternately in positive and negative directions. In other words, a total of four pulses having a voltage bringing the antiferroelectric liquid crystal to a ferroelectric state are applied during the first scanning period. According to the waveform, the antiferroelectric liquid crystal assumes the second and first ferroelectric states during the reset period. The amount of transmitted light in the first ferroelectric state is equivalent to the one in the second ferroelectric state. The transmittance does not change during the reset period.

The polarity of a voltage to be applied during the reset period immediately preceding the selection period is positive. Immediately before the selection period, therefore, the antiferroelectric liquid crystal assumes the first ferroelectric state. The amount of transmitted light (T) approaches 100%. During the succeeding selection period, since −25 V is applied to pixels by one phase (select pulse), the antiferroelectric liquid crystal does not shift to a ferroelectric state to be set with application of a voltage of opposite polarity. The antiferroelectric state is selected, and the amount of transmitted light becomes 0%. A black display ensues. During the non-selection period, the antiferroelectric liquid crystal retains the antiferroelectric state. The reset period is shorter than the time required for a viewer to discern a change in display. The display is therefore discerned as black.

For a white display, likewise, a voltage independent on the state of display, having an absolute value of 21 V or higher, and consisting of two phases is applied to pixels alternately in positive and negative directions during the reset period. In other words, two pulses of opposite polarities bringing the antiferroelectric liquid crystal to a ferroelectric state are applied during the reset period. According to the waveform, the antiferroelectric liquid crystal assumes the second and first ferroelectric states. The polarity of a voltage to be applied during the reset period immediately preceding the selection period is positive. The antiferroelectric liquid crystal assumes the first ferroelectric state. The amount of transmitted light approaches to 100% during the reset period. During the succeeding selection period, since −17 V is applied to pixels by one phase (select pulse), the antiferroelectric liquid crystal does not shift to the antiferroelectric state but enters a ferroelectric state to be set with a voltage of the same polarity. The amount of transmitted light approaches 100%. A white display ensues. During the non-selection period, the antiferroelectric liquid crystal retains the ferroelectric state to be set with a voltage of the same polarity as the voltage applied during the reset period. A white display ensues.

According to the driving method illustrated in FIG. 2, the antiferroelectric liquid crystal switches to both the first ferroelectric state and second ferroelectric state during the reset period. A bipolar pulse of a sufficiently high voltage is applied continuously. The angle of bend of the layer of the antiferroelectric liquid crystal can therefore be saturated independently of display pixels. Consequently, a difference in threshold voltage deriving from a difference in state of display can be eliminated. Moreover, the application range of a reset pulse is wide, and the time required for resetting the antiferroelectric liquid crystal to a ferroelectric state is short. Even for a black display and white a display alike, the selection time can be shortened. For any display screen, an excellent display can be achieved quickly.

In the embodiment illustrated in FIG. 2, the reset period includes periods during which the antiferroelectric liquid crystal is brought to the first ferroelectric state and second ferroelectric state respectively. A period during which the antiferroelectric liquid crystal is brought into the antiferroelectric state may be defined within the reset period. Even in this case, a similar effect of resolving an after-image phenomenon can be exerted.

In this embodiment, driving for an antiferroelectric liquid crystal having a plurality of scan electrodes and a plurality of signal electrodes has been described. Even in driving for an antiferroelectric liquid crystal in which, for example, active elements such as switching elements are used as pixels, as long as a voltage to be applied to pixels is a synthetic voltage similar to the one employed in this embodiment, the same effect is exerted.

Figure 3:
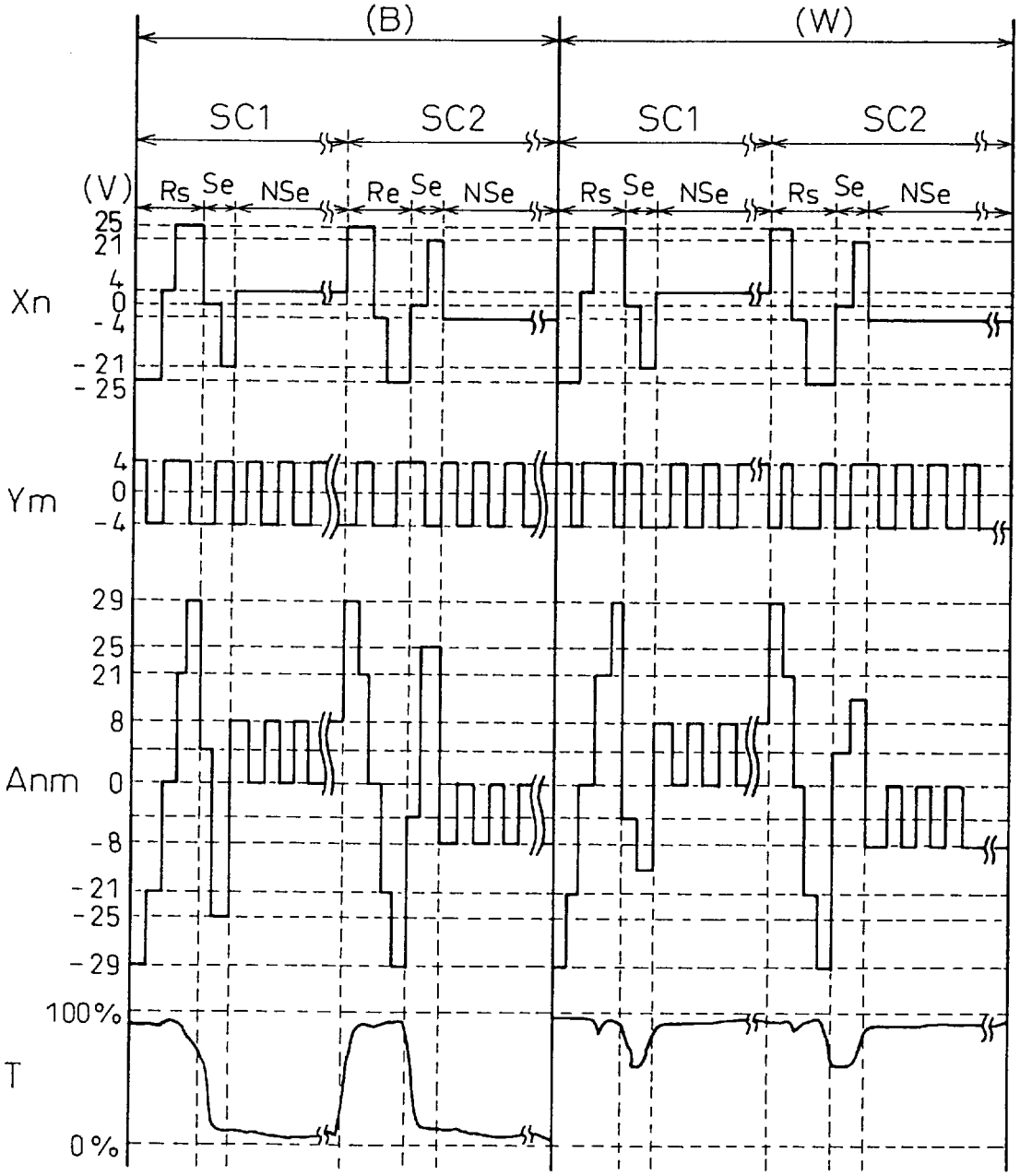
FIG. 3 is an explanatory diagram of a driving method of yet another embodiment of the present invention.

FIG. 3 is an explanatory diagram of a driving method of yet another embodiment of the present invention. In this case, three kinds of reset pulses are used and applied during a reset period (Rs). The three kinds of reset pulses are pulses of +29 V, 0 V, and −29 V to be applied during the reset period as illustrated. During the reset period, an antiferroelectric liquid crystal assumes a first ferroelectric state, second ferroelectric state, and antiferroelectric state. This method is identical to the one illustrated in FIG. 2 except that a voltage of positive polarity, zero voltage, and voltage of negative polarity are used instead of voltages of positive and negative polarities.

Figure 4:
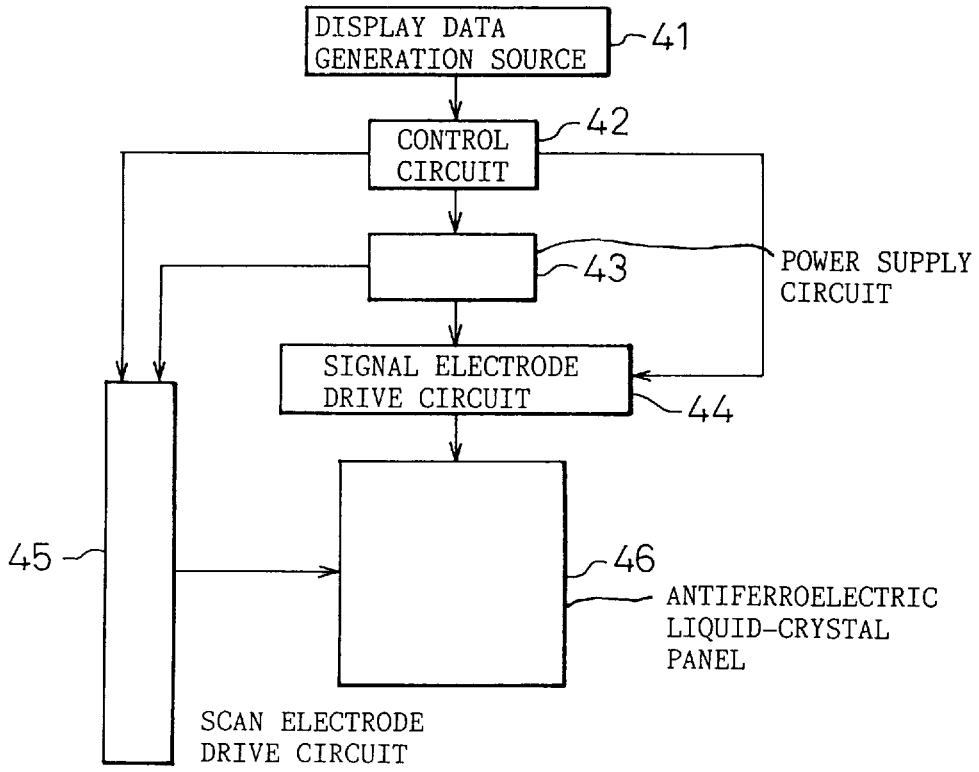
FIG. 4 is a block configuration diagram of a system in which the present invention is implemented.

FIG. 4 is a block configuration diagram of a system in which the present invention is implemented. In the drawing, there are shown a display data generation source 41 for generating data to be displayed on a liquid-crystal panel 46, and a control circuit 42. Based on display data provided by the display data generation source 41, a scan electrode drive circuit 45 and signal electrode drive circuit 44 are controlled in order to control driving waves during first and second scanning periods. Furthermore, the control circuit 42 controls the timing of supplying power from a power supply circuit 43 to electrodes.

First, display data is input to the control circuit 42. The control circuit 42 produces information such as the timing and voltages of signals corresponding to the display data and conformable to the waveforms shown in any of FIGS. 1 to 3. The information is input to the scan electrode drive circuit 45 and signal electrode drive circuit 44. Signals of the timing and voltages instructed by the control circuit 42 are then output to the antiferroelectric liquid-crystal panel 46 through output pins of the drive circuits.

INDUSTRIAL APPLICABILITY

As described in the embodiments, using a driving method and system of the present invention, an antiferroelectric liquid crystal is reset to a ferroelectric state during a reset period. Consequently, pixels that are objects of writing can be reset quickly. Furthermore, a change in layer structure deriving from continuous driving can be corrected, and a printing phenomenon deriving from a difference in structure of a liquid-crystal layer from pixel to pixel can be alleviated. Moreover, since the subsequent state of the antiferroelectric liquid crystal can be determined during a short selection period, an excellent, quick and high-contrast display can be achieved.

What is claimed is:

1. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period includes a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said antiferroelectric liquid crystal is brought to said first or second ferroelectric state during said reset period;

said select pulse is set to 0 V or a pulse that is opposite in polarity to said reset pulse; and said antiferroelectric liquid crystal is brought to said antiferroelectric state during said non-selection period or a ferroelectric state that is the same as a ferroelectric state to be set during said reset period.

2. A driving method for an antiferroelectric liquid-crystal display device having an antiferroelectric liquid crystal interposed between a pair of substrates that have a plurality of scan electrodes and a plurality of signal electrodes on opposed sides thereof, and including pixels in the form of a matrix, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period includes a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said antiferroelectric liquid crystal is set to said first or second ferroelectric state during said reset period;

said select pulse is set to 0 V or a pulse that is opposite in polarity to said reset pulse; and a voltage to be applied to said scan electrodes during said reset period is set to have the same polarity as a voltage to be applied thereto during said non-selection period.

3. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained; and said reset period is defined so that a period during which said antiferroelectric liquid crystal assumes said first ferroelectric state and a period during which said antiferroelectric liquid crystal assumes said second ferroelectric state are included in the same reset period.

4. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained; and at least two kinds of reset pulses for bringing said antiferroelectric liquid crystal to said first ferroelectric state and second ferroelectric state are applied to said antiferroelectric liquid crystal during the same reset period.

5. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained; and said reset period is defined so that a period during which said antiferroelectric liquid crystal assumes said first ferroelectric state, a period during which said antiferroelectric liquid crystal assumes said second ferroelectric state, and a period during which said antiferroelectric liquid crystal assumes said antiferroelectric state are included in the same reset period.

6. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained; and at least three kinds of reset pulses for bringing said antiferroelectric liquid crystal to said first ferroelectric state, second ferroelectric state, and antiferroelectric state are applied to said antiferroelectric liquid crystal during the same reset period.

7. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said reset period is defined so that a period during which said antiferroelectric liquid crystal assumes said first ferroelectric state and a period during which said antiferroelectric liquid crystal assumes said second ferroelectric state are included in the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set during said reset period immediately preceding the start of said selection period during said non-selection period.

8. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

at least two kinds of reset pulses for bringing said antiferroelectric liquid crystal to said first ferroelectric state and second ferroelectric state are applied to said antiferroelectric liquid crystal during the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set during said reset period immediately preceding the start of said selection period during said non-selection period.

9. A driving method for an antiferroelectric liquid-crystal display device having an antiferroelectric liquid crystal interposed between a pair of substrates that have a plurality of scan electrodes and a plurality of signal electrodes on opposed sides thereof, and including pixels in the form of a matrix, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said reset period is defined so that a period during which said antiferroelectric liquid crystal assumes said first ferroelectric state and a period during which said antiferroelectric liquid crystal assumes said second ferroelectric state are included in the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

10. A driving method for an antiferroelectric liquid-crystal display device having an antiferroelectric liquid crystal interposed between a pair of substrates that have a plurality of scan electrodes and a plurality of signal electrodes on opposed sides thereof, and including pixels in the form of a matrix, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

at least two kinds of reset pulses for bringing said antiferroelectric liquid crystal to said first ferroelectric state and second ferroelectric state are applied to said antiferroelectric liquid crystal during the same reset period, and said select pulse is set to 0 V or a pulse that is opposite in polarity to a last reset pulse for determining a ferroelectric state within said reset pulse; and a voltage to be applied to said scan electrodes immediately before the start of said selection period within said reset period is set to have the same polarity as a voltage to be applied thereto during said non-selection period.

11. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said reset period is defined so that a period during which said antiferroelectric liquid crystal assumes said first ferroelectric state, a period during which said antiferroelectric liquid crystal assumes said second ferroelectric state, and a period during which said antiferroelectric liquid crystal assumes said antiferroelectric state are included in the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set immediately before the start of said selection period within said reset period during said non-selection period.

12. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

at least three kinds of reset pulses for bringing said antiferroelectric liquid crystal to said first ferroelectric state, second ferroelectric state, and antiferroelectric state are applied to said antiferroelectric liquid crystal during the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set immediately before the start of said selection period within said reset period during said non-selection period.

13. A driving method for an antiferroelectric liquid-crystal display device having an antiferroelectric liquid crystal interposed between a pair of substrates that have a plurality of scan electrodes and a plurality of signal electrodes on opposed sides thereof, and including pixels in the form of a matrix, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

said reset period is defined so that a period during which said antiferroelectric liquid crystal assumes said first ferroelectric state, a period during which said antiferroelectric liquid crystal assumes said second ferroelectric state, and a period during which said antiferroelectric liquid crystal assumes said antiferroelectric state are included in the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

14. A driving method for an antiferroelectric liquid-crystal display device having an antiferroelectric liquid crystal interposed between a pair of substrates that have a plurality of scan electrodes and a plurality of signal electrodes on opposed sides thereof, and including pixels in the form of a matrix, characterized in that:

said antiferroelectric liquid crystal assumes a first ferroelectric state, a second ferroelectric state that is a ferroelectric state to be set with application of a voltage which is opposite in polarity to a voltage to be applied to set the first ferroelectric state, and an antiferroelectric state;

one writing of pixels is carried out during at least one scanning period;

said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during the selection period is retained;

at least three kinds of reset pulses for bringing said antiferroelectric liquid crystal to said first ferroelectric state, second ferroelectric state, and antiferroelectric state are applied to said antiferroelectric liquid crystal during the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

15. A driving method for an antiferroelectric liquid-crystal display device according to any of claims 1 to 14, wherein the waveform of each voltage to be applied during consecutive scanning periods is symmetrical with respect to 0 V.

16. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said antiferroelectric liquid crystal assumes a first or second ferroelectric state during said reset period;

said select pulse is set to 0 V or a pulse that is opposite in polarity to said reset pulse; and said antiferroelectric liquid crystal is brought to an antiferroelectric state or a ferroelectric state that is the same as a ferroelectric state to be set during said reset period during said non-selection period.

17. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said antiferroelectric liquid crystal assumes a first or second ferroelectric state during said reset period;

said select pulse is set to 0 V or a pulse that is opposite in polarity to said reset pulse; and a voltage to be applied to said scan electrodes during said reset period is set to have the same polarity as a voltage to be applied thereto during said non-selection period.

18. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained; and said reset period is defined so that a period during which said antiferroelectric liquid crystal assumes a first ferroelectric state and a period during which said antiferroelectric liquid crystal assumes a second ferroelectric state are included in the same reset period.

19. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained; and at least two kinds of reset pulses for bringing said antiferroelectric liquid crystal to a first ferroelectric state and a second ferroelectric state are applied to said antiferroelectric liquid crystal during the same reset period.

20. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained; and said reset period is defined so that a period during which said antiferroelectric liquid crystal assumes a first ferroelectric state, a period during which said antiferroelectric liquid crystal assumes a second ferroelectric state, and a period during which said antiferroelectric liquid crystal assumes an antiferroelectric state are included in the same reset period.

21. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained; and at least three kinds of reset pulses for bringing said antiferroelectric liquid crystal to a first ferroelectric state, second ferroelectric state, and antiferroelectric state are applied to said antiferroelectric liquid crystal during the same reset period.

22. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said reset period is defined so that a period during which said antiferroelectric liquid crystal assumes a first ferroelectric state and a period during which said antiferroelectric liquid crystal assumes a second ferroelectric state are included in the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set during said reset period immediately preceding the start of said selection period during said non-selection period.

23. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

at least two kinds of reset pulses for bringing said antiferroelectric liquid crystal to a first ferroelectric state and second ferroelectric state are applied to said antiferroelectric liquid crystal during the same reset period;

said select pulse is set to 0 V or a pulse that is opposite in polarity to a last reset pulse for determining a ferroelectric state within said reset period; and said antiferroelectric liquid crystal is brought to an antiferroelectric state or a ferroelectric state that is the same as a ferroelectric state to be set during said reset period immediately preceding the start of said selection period during said non-selection period.

24. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said reset period is defined so that a period during which said antiferroelectric liquid crystal assumes a first ferroelectric state and a period during which said antiferroelectric liquid crystal assumes a second ferroelectric state are included in the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

25. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

at least two kinds of reset pulses for bringing said antiferroelectric liquid crystal to a first ferroelectric state and second ferroelectric state are applied to said antiferroelectric liquid crystal during the same reset period, and said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

26. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said reset period is defined so that a period during which said antiferroelectric liquid crystal assumes a first ferroelectric state, a period during which said antiferroelectric liquid crystal assumes a second ferroelectric state, and a period during which said antiferroelectric liquid crystal assumes an antiferroelectric state are included in the same reset period;

said select pulse is set to 0 V or a pulse that is opposite in polarity to a last reset pulse for determining a ferroelectric state within said reset period;

said antiferroelectric liquid crystal is brought to an antiferroelectric state or a ferroelectric state that is the same as a ferroelectric state to be set immediately before the start of said selection period within said reset period during said non-selection period.

27. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

at least three kinds of reset pulses for bringing said antiferroelectric liquid crystal to a first ferroelectric state, second ferroelectric state, and antiferroelectric state are applied to said antiferroelectric liquid crystal during the same reset period;

said select pulse is set to 0 V or a pulse that is opposite in polarity to a last reset pulse for determining a ferroelectric state within said reset period; and said antiferroelectric liquid crystal is brought to said antiferroelectric state or a ferroelectric state that is the same as a ferroelectric state to be set immediately before the start of said selection period within said reset period during said non-selection period.

28. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

said reset period is defined so that a period during which said antiferroelectric liquid crystal assumes a first ferroelectric state, a period during which said antiferroelectric liquid crystal assumes a second ferroelectric state, and a period during which said antiferroelectric liquid crystal assumes an antiferroelectric state are included in the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

29. A driving system for an antiferroelectric liquid-crystal display device including pixels in the form of a matrix and having an antiferroelectric liquid crystal interposed between a pair of substrates, comprising:

a means for generating display data;

a driving means for driving scan electrodes;

a driving means for driving signal electrodes;

a power supply means for supplying a given voltage to said pixels; and a control means for receiving said display data, producing the timing and voltages of signals corresponding to said display data, and supplying the timing and voltages to said scan electrode driving means and said signal electrode driving means, wherein said control means gives control so that:

one writing of pixels is carried out during at least one scanning period, and said scanning period is defined to include a selection period during which a select pulse for determining an amount of light transmitted by pixels is applied, a reset period during which a reset pulse for bringing said antiferroelectric liquid crystal to a certain state is applied prior to the selection period, and a non-selection period during which the amount of transmitted light determined during said selection period is retained;

at least three kinds of reset pulses for bringing said antiferroelectric liquid crystal to a first ferroelectric state, second ferroelectric state, and antiferroelectric state are applied to said antiferroelectric liquid crystal during the same reset period;

said select pulse is set to 0 V or a pulse that is opposite in polarity to a last reset pulse for determining a ferroelectric state within said reset period; and a voltage to be applied to said scan electrodes immediately before the start of said selection period within said reset period is set to have the same polarity as a voltage to be applied thereto during said non-selection period.

30. A driving system for an antiferroelectric liquid-crystal display device according to any of claims 16 to 29, wherein said control means gives control so that the waveform of each voltage to be applied during consecutive scanning periods is symmetrical with respect to 0 V.

* * * * *